US011202538B2

(12) United States Patent
Heydari

(10) Patent No.: US 11,202,538 B2
(45) Date of Patent: Dec. 21, 2021

(54) WATER INLET THROUGH SEAT POST

(71) Applicant: AS America, Inc., Piscataway, NJ (US)

(72) Inventor: Behnam Heydari, Ridgewood, NJ (US)

( * ) Notice: Subject to any disclaimer, the term of this patent is extended or adjusted under 35 U.S.C. 154(b) by 0 days.

(21) Appl. No.: 16/955,587

(22) PCT Filed: Dec. 19, 2018

(86) PCT No.: PCT/US2018/066600

§ 371 (c)(1),
(2) Date: Jun. 18, 2020

(87) PCT Pub. No.: WO2019/133402

PCT Pub. Date: Jul. 4, 2019

(65) Prior Publication Data

US 2021/0093130 A1 Apr. 1, 2021

Related U.S. Application Data

(60) Provisional application No. 62/610,715, filed on Dec. 27, 2017.

(51) Int. Cl.

| | |
|---|---|
| ***A47K 13/26*** | (2006.01) |
| ***A47K 13/30*** | (2006.01) |
| ***E03D 9/08*** | (2006.01) |
| ***E03C 1/12*** | (2006.01) |

(52) U.S. Cl.
CPC ..... *A47K 13/26* (2013.01); *A47K 13/302* (2013.01); *E03D 9/08* (2013.01); *E03C 1/12* (2013.01); *E03C 2001/1213* (2013.01)

(58) Field of Classification Search
CPC ..... A47K 13/00
USPC ..... 4/237, 234, 98, 217, 238, 239
See application file for complete search history.

(56) References Cited

U.S. PATENT DOCUMENTS

2013/0016019 A1 6/2013 Collingnon

FOREIGN PATENT DOCUMENTS

| | | |
|---|---|---|
| CN | 2642868 Y | 9/2004 |
| CN | 2921124 Y | 7/2007 |

OTHER PUBLICATIONS

International Search Report dated Mar. 14, 2019 in corresponding International Application No. PCT/US2018/06600(2pages).

*Primary Examiner* — Lori L Baker
(74) *Attorney, Agent, or Firm* — Tyler A. Stevenson; Anna-Lisa L. Gallo

(57) ABSTRACT

A system for suppling water to a toilet through a hole located in the toilet. The hole may be the hole provided for securing the toilet seat to the toilet. The hole may be provided with a hollow fastener for both securing the toilet seat to the toilet and for supplying water to the toilet. The system may supply water from a source to a component of the toilet, such as a bidet seat or a toilet bowl cleaning seat.

21 Claims, 2 Drawing Sheets

WATER INLET THROUGH SEAT POST

CROSS-REFERENCE TO RELATED APPLICATIONS

This application claims priority to U.S. Provisional Patent Application No. 62/610,715, filed Dec. 27, 2017, hereby incorporated by reference in its entirety.

TECHNICAL FIELD OF THE INVENTION

The present inventions relate generally to systems and methods for a water inlet through a seat post. More specifically, for a water inlet through a seat post for a bidet or toilet bowl cleaning seat.

BACKGROUND OF THE INVENTION

Current toilets and bidets are provided with features which require additional waterlines. For example, a toilet bowl cleaning seat requires an additional water line to the toilet seat, toilet seat lid, and/or toilet bowl to provide water to the area to be cleaned. Similarly, in bidets, water needs to be provided to the bidet seat to rinse the user and/or the toilet bowl. Current bidets include water lines and inlets which extend around an exterior side of the bidet to connect to a water inlet. Current bidet seats have water inlet connections on the side. The water lines and connections are intrusive. Thus, a need exists for a waterline which is unobtrusive and extends through a seat post in a toilet or bidet.

BRIEF SUMMARY OF THE INVENTION

According to an embodiment, a toilet may include a toilet body having a toilet bowl with a rim; a hole located in the rim; and a fluid line configured to couple to a seat post positioned in the hole, wherein a fluid is delivered to a component of the toilet through the fluid line. The component may be a toilet bowl cleaning seat or a bidet seat. The fluid line may be a waterline and the fluid is water, and wherein the waterline delivers water to the toilet bowl cleaning seat or the bidet seat. The fluid line passes through the seat post. The seat post may be hollow. The fluid line further comprising a first end configured to be coupled to a water source and a second end configured to be coupled to the component. The hole is located in a rear portion of the rim.

The toilet may include a junction, the junction diverging flow from the fluid line to a toilet tank and to the component of the toilet. The junction is a tee-shaped fitting.

The toilet may include a junction, the junction diverging flow from the fluid line to a toilet tank and to a second fluid line, the second fluid line coupling to the component of the toilet. The junction further diverging flow to a third fluid line. The second fluid line couples to the seat post and the third fluid line couples to a second seat post.

The seat post may be a seat post of a toilet seat assembly. The seat post is a hollow seat post and wherein the toilet seat assembly further comprises a second seat post.

The toilet may include an inlet coupled to the seat post, the inlet configured to couple the fluid line to the seat post. The inlet is integrally formed with the seat post. The seat post is the inlet and is directly coupled to the fluid line.

The toilet may be a flat sided toilet. The fluid line and the seat post may be hidden from view when the toilet is installed.

The toilet may include junction for diverging flow from the fluid line to a toilet tank and to a second fluid line, the second fluid line coupling to the component of the toilet, and wherein the fluid line, the second fluid line, the junction, and the seat post are hidden from view when the toilet is installed.

According to an embodiment, a toilet seat assembly may include a toilet seat; a first seat post configured to allow fluid to flow therethrough; and a second seat post, wherein the first seat post and the second seat post are configured to couple the toilet seat assembly to a toilet. The first seat post is hollow and the second seat post is solid. The at least one of the first seat post and the second seat post are hollow. The toilet seat assembly is a bidet seat or a toilet bowl cleaning seat. The toilet seat assembly is configured to replace an existing toilet seat assembly on a toilet. The toilet seat assembly may include an inlet coupled to the first seat post, wherein the inlet is configured to admit fluid to the first seat post. The inlet is integral with the first seat post.

BRIEF DESCRIPTION OF DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION OF THE INVENTIONS

According to embodiments of the invention, a water inlet to supply water to a toilet bowl cleaning seat or bidet seat may be drawn through the holes where the bolts attach to the toilet seat, such as the seat post holes. Water used for a bidet seat or a toilet bowl cleaning seat may be supplied through the waterline. Various implementations of the invention are contemplated. One implementation is providing the water inlet through the seat post of the seat. Another implementation is providing the water inlet through the hole or seat post hole for the toilet seat. Other implementations may distribute the water from the seat post and/or seat post hole to various outlets on the toilet and/or bidet.

Figure 1:
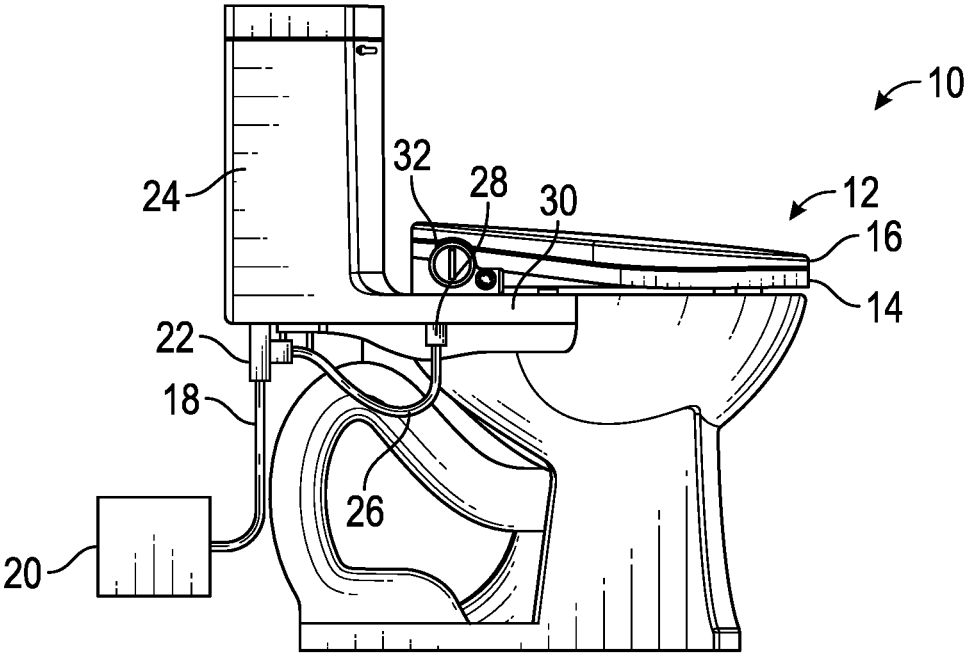
FIG. 1 shows a side view of a toilet having a water inlet in a seat post, according to an embodiment of the disclosure.

Referring to FIG. 1, a perspective view of a toilet 10 is shown. The toilet 10 may be any toilet, including, but not limited to a wash down toilet, a siphonic toilet, a wall hung toilet, a gravity fed toilet, or a bidet toilet, etc. The toilet 10 may include a toilet seat assembly 12. The toilet seat assembly 12 may be a toilet bowl cleaning seat (FIG. 3) or a bidet seat (FIG. 4). The toilet seat assembly 12 may include a toilet seat 14 and a toilet seat lid 16. The toilet 10 may have a first waterline 18 coupling the toilet 10 to a water source 20. The first waterline 18 may extend to a junction 22. The junction 22 may supply water to both a toilet tank 24 and a second waterline 26. The junction 22 may be a tee-shaped fitting for splitting the first waterline 18 into two directions, a first direction into the toilet tank 24 and a second direction into second waterline 26. The junction 22 may be directly fitted to the toilet tank 24 or may be coupled to the toilet tank 24 with tubing or hosing. Alternatively, or additionally, the junction 22 may include one or more valves for controlling the flow of water from the water source 20 to the toilet tank 24 and the second waterline 26.

Figure 2:
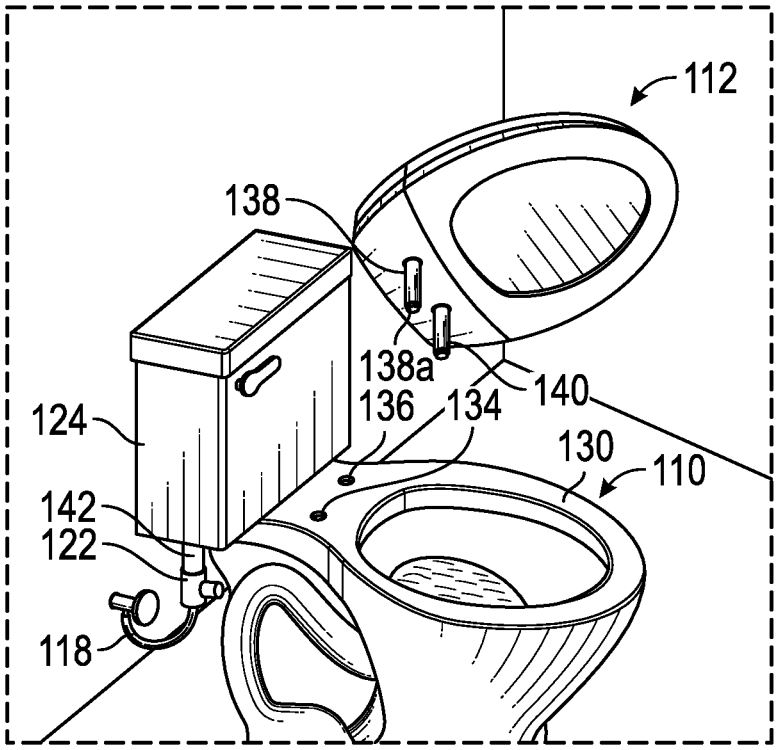
FIG. 2 shows a perspective view of a toilet with the toilet seat removed, according to an embodiment of the disclosure.

Although shown as a tee-shaped fitting, the junction 22 may be any connection which allows for a fluid line to be split from a single fluid line to more than one fluid line. Although shown splitting the first waterline 18 into two directions (to tank 24 and to the second waterline 26), the junction 22 may split the first waterline 18 into more than two directions. For example the junction 22 may split the flow into three directions, to tank 24, to the second waterline 26 and to a third waterline (not shown). The third waterline may allow flow of water to the second seat post 140 (FIG. 2). Additionally, although described as waterlines, the flow lines described herein may allow for flow of any fluid, not limited to water, such as, for example, cleaning detergent.

With continued reference to FIG. 1, the second waterline 26 may extend to a water inlet 28. The water inlet 28 may extend through the rim 30 to a portion 32 of the toilet seat assembly 12. The portion 32 may be a cleaning system when the toilet seat assembly 12 is a toilet bowl cleaning seat or bidet seat. The water inlet 28 may be formed integral with a hole (not visible) in the rim 30. Alternatively, the water inlet 28 may be a component which extends through the hole (not visible) in the rim 30. The water inlet 28 may be a hollow seat post from a toilet seat. The second waterline 26 may extend through the water inlet 28. Alternatively, the second waterline 26 may be coupled to the water inlet 28. Although not visible, the hole may be the same or similar as the first hole 134 and/or second hole 136 in FIG. 2.

Referring to FIG. 2, a perspective view of an alternative toilet 110 is shown. The toilet 110 may be the same or similar to the toilet 10. In the perspective view of FIG. 2, toilet seat assembly 112 is removed. For clarity of description, the second waterline (26 in FIG. 1) is not depicted, however it may be appreciated that a second waterline may run from the junction 122 to the toilet 110, such as through or coupled to the first seat post 138 as will be described. The toilet 110 may include a first hole 134 and a second hole 136 which may be seat post holes. The first hole 134 and second hole 136 may receive a first seat post 138 and a second seat post 140, respectively. One or both of the first seat post 138 and second seat post 140 may accommodate a water inlet, such as water inlet 28 (FIG. 1). For example, first seat post 138 may be hollow and second seat post 140 may be solid. In this example, the first seat post 138 is the water inlet 28 or alternatively, the water inlet 28 couples to or extends through the first seat post 138. The toilet seat assembly 112 is aligned with the rim 130 such that the first seat post 138 aligns with the first hole 134 and the second seat post 140 aligns with the second hole 136. The toilet seat assembly 112 may then be lowered onto the rim 130 such that the seat posts 138 and 140 extend through the holes 134 and 136, respectively. The first seat post 138 extends through the first hole 134 and a bottom end 138*a* may be coupled to the second waterline (not depicted). Alternatively, the first seat post 138 extends through the first hole 134 and the second waterline (not depicted) extends through the hollow seat post 138.

The first seat post 138 and the second seat post 140 may be seat posts for securing the toilet seat assembly 112 to the toilet 110. The first seat post 138 and/or the second seat post 140 may be bolts, fasteners, or other connection types. The bolt or other fasteners may be substantially hollow such that water supplied in the second waterline is not obstructed by the bolt. The first hole 134 and second hole 136 may be positioned at a location complementary to a toilet seat connection assembly (not depicted) of the toilet seat assembly 112 to couple the same to the toilet 110. The first seat post 138, second seat post 140, and/or water inlet 28 may be formed of a material capable of maintaining integrity during prolonged exposure to water, such as, for example, stainless steel or plastic.

It may be appreciated from the foregoing that one or both of first seat post 138 and second seat post 140 may be water inlets or may accommodate water inlets. Additionally, one or both of the hollow seat posts or the solid seat posts may be fasteners or bolts for securing the toilet seat assembly 112 to the rim 130. As previously described, the first seat post 138 may be hollow and may be the same as the water inlet 28 (FIG. 1) or may accommodate a fitting or coupling which may be or may couple to the water inlet 28 (FIG. 1). As may be appreciated from FIG. 2, water may be supplied from a water source 20 (FIG. 1) to a first waterline 118. The water source 20 may be located within or behind the wall such that it is not visible in FIG. 2. The first waterline 118 may be coupled to the second waterline 26 (omitted in FIG. 2 for clarity) via the junction 122. The junction 122 may be coupled directly to the tank 124 (as in FIG. 1) or may be coupled to a tank waterline 142 which may in turn be coupled to the tank 124. The second waterline may be coupled to the first seat post 138 for supplying water to the toilet seat assembly 112, which may be a toilet bowl cleaning seat (FIG. 3) or a bidet seat (FIG. 4). Alternatively, or additionally, the second waterline may be coupled to the second seat post 140. Thus, in operation, when a cleaning system of the toilet bowl cleaning seat or bidet seat is actuated, water may be permitted to flow from the water source, through the first waterline 118, through the second waterline 26 (FIG. 1), through the first seat post 138, and into the toilet seat assembly 112 to be delivered to clean the toilet bowl or to clean a user or for other purposes.

Although the seat posts 138 and 140 are depicted as attached to the toilet seat assembly 112 for insertion through holes 134 and 136, respectively, alternative modes may be contemplated. For example, the seat posts 138 and 140 may be integral with the rim 130 and may be coupled to the toilet seat assembly 112 with any connection type. Alternatively, the seat posts 138 and 140 may be omitted or may be supplied in an alternative location such that the seat posts 138 and 140 do not obstruct the flow of water through the second waterline. If the seat posts 138 and/or 140 are omitted in the toilet 110, the toilet seat assembly 112 may be secured to the rim 130 with other connection types, such as, for example, adhesives. Water lines may still be coupled to the holes 134 and 136 when seat posts 138 and 140 are omitted.

Figure 3:
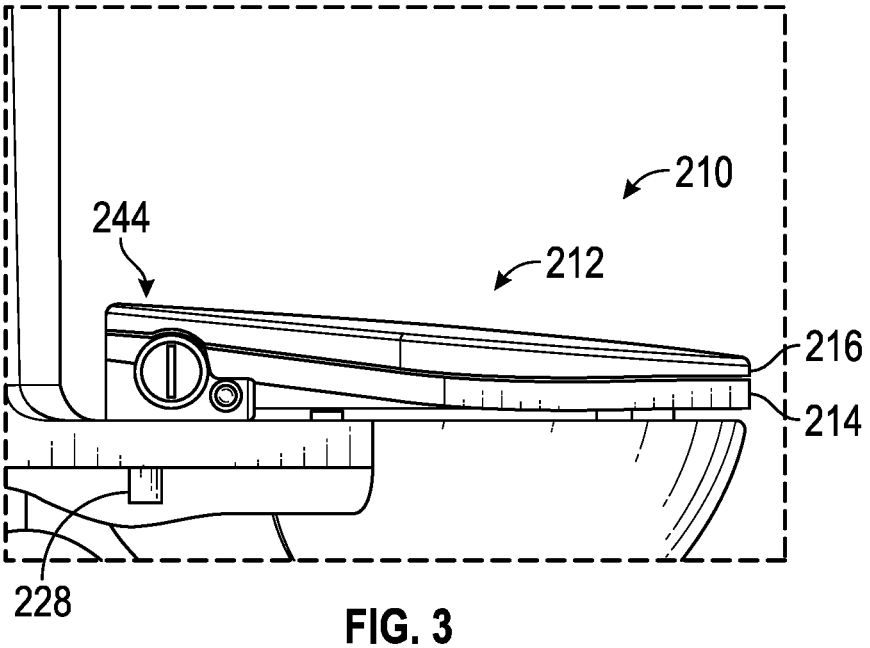
FIG. 3 shows a side view a toilet having a toilet bowl cleaning seat, according to an embodiment of the disclosure.
Figure 4:
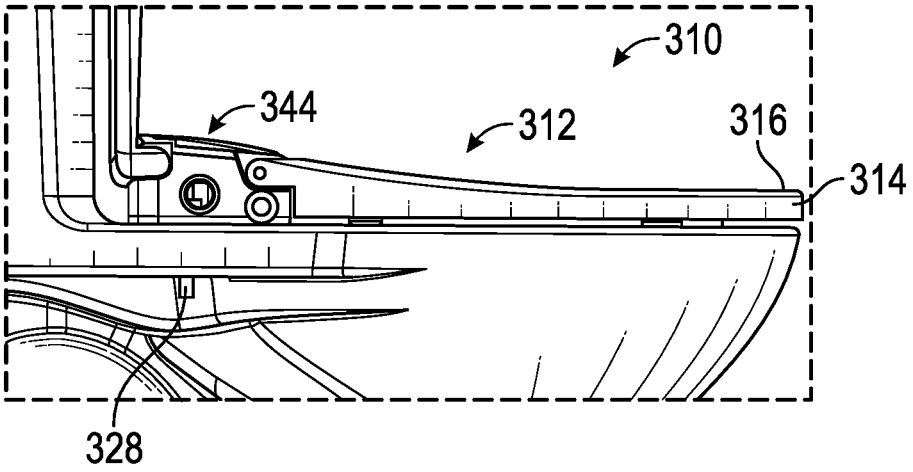
FIG. 4 shows a side view of a toilet having a bidet seat, according to an embodiment of the disclosure.

Referring to FIG. 3, a side view of a toilet seat assembly 212 of a toilet 210 is shown. The toilet seat assembly 212 may be a toilet bowl cleaning seat having a toilet seat 214 and toilet seat lid 216 in a closed position. As may be appreciated from FIG. 3, the toilet bowl cleaning seat may include a cleaning system 244. The cleaning system 244 may be fluidically coupled to a water source (such as water source 20 in FIG. 1) via the water inlet 228. The water inlet 228 may be provided in any of the previously described manners, including through a hollow seat post in toilet bowl cleaning seat. The water inlet 228 may be coupled to the second waterline 26 (FIG. 1) for supplying water to the cleaning system 244. Alternatively, the second waterline 26 (FIG. 1) may extend through the water inlet 228. The water inlet 228 may be a seat post which extends through a first hole (not depicted), such as a seat post hole. The first hole may be similar to first hole 134 of toilet 110. Additionally more water inlets 228 may be provided to supply water to additional portions of toilet 210. In operation, the water inlet 228 may supply water to be mixed with a cleaning solution and delivered to the toilet bowl via a nozzle or hole.

Referring to FIG. 4, a side view of a toilet seat assembly 312 of a toilet 310 is shown. The toilet seat assembly 312 may be a bidet seat having a toilet seat 314 and toilet seat lid 316 in a closed position. As may be appreciated from FIG. 4, the bidet seat may include a cleaning system 344. The cleaning system 344 may be fluidically coupled to a water source (such as water source 20 in FIG. 1) via the water inlet 328. The water inlet 328 may be provided in any of the previously described manners, including through a hollow seat post in bidet seat. The water inlet 328 may be coupled to the second waterline 26 (FIG. 1) for supplying water to the cleaning system 344. Alternatively, the second waterline 26 (FIG. 1) may extend through the water inlet 328. The water inlet 328 may be a seat post which extends through a first hole (not depicted), such as a seat post hole. The first hole may be similar to first hole 134 of toilet 110. Additionally more water inlets 328 may be provided to supply water to additional portions of toilet 310. In operation, the water inlet 328 may supply water to a nozzle or hole in the cleaning system 344 to clean or rinse a user.

In the toilet seat assembly of FIGS. 1 and 2, the toilet bowl cleaning seat of FIG. 3 and/or in the bidet of FIG. 4, the second seat post (140 in FIG. 2) may be coupled to another fluid line, such as a fluid line couple to a source of a cleaning detergent, disinfectant, soap, etc. Thus, the toilet may be coupled to both a water source and another fluid source through the seat posts. This may allow for multiple fluids to be supplied to the toilet seats through the seat posts.

Referring to FIGS. 1-4, in operation, water may be supplied from the water source to the second waterline, through the water inlet located in the first hole of the toilet, and into the internal components of the cleaning systems (244 or 344) for operation of the toilet bowl cleaning seat or bidet seat. It may be appreciated that the water may be supplied to any of the components located in the cleaning systems, including, but not limited to a valve, venturi, and/or a mixer.

It may be appreciated from the foregoing disclosure that a toilet allowing water (or other fluid) to flow from a water source (or other fluid source) to a portion of a toilet through a hole, seat post hole, and/or seat post located in the rim of the toilet is provided. The water supplied to the hole may then be delivered to a component of the toilet or to a secondary device, such as, a toilet bowl cleaning seat or a bidet seat, or other parts of the toilet such as alternative cleaning systems, or other toilet components or add-ons which require water. Although not depicted, a valve or flow control mechanism may be provided with any of the waterlines or holes to control the timing, direction, and flow of water and fluids through the various toilets and components of the toilets.

As may be appreciated from the foregoing disclosure, the disclosed embodiments combine the water inlet with the seat post to simplify the connection. The water inlet may be, for example, a threaded tube or hollow bolt that may be used both as a water inlet to components of the toilet and as a connection to hold the toilet seat in place on the toilet body. The disclosed embodiments may also be used for toilet bowl cleaning seats. Thus, a cleaner, less intrusive water line connection may be provided.

Accordingly, the present disclosure provides a fluid connection through a hollow post. Although described as a seat post, the post may be any post or connection point that may be formed in a hollow manner so as to allow fluid to flow through. Although described for use in toilet bowl cleaning seats, bidets, and other toilets, the fluid connection of the present disclosure may be provided in any apparatus, assembly, or device that uses water or other fluids to operate. The fluid connection through a hollow post may allow for a flat sided toilet with a bidet seat where the fluid connections and/or lines are hidden from view. For example, the toilet, bidet, and/or toilet with bidet seat, may have a flat side such that the trapway and/or any fluid couplings are not visible. The fluid lines may be run through a rear surface of the toilet or bidet within the interior of the flat sides. A hole may then be punched or formed in the rim of the toilet, as previously described, and the fluid line may extend through the hole and/or couple to the hole for connection to the components of the toilet. In the context of FIG. 1, this would result in the first waterline 18, junction 22, the second waterline 26, water inlet 28, and trapway hidden from view within a flat sided toilet.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A toilet comprising:

a toilet body having a toilet bowl with a rim;

a toilet tank;

a hole located in the rim; and a junction for diverging fluid flow from a first fluid line to a toilet tank bottom and to a second fluid line, wherein the second fluid line is configured to couple to a first seat post positioned in the hole, a fluid is delivered to a toilet bowl cleaning seat or a bidet seat of the toilet through the second fluid line, and the junction is directly fitted to the toilet tank bottom or is coupled to the toilet tank bottom with tubing or housing.

2. The toilet of claim 1, wherein the fluid comprises cleaning detergent.

3. The toilet of claim 1, wherein the first fluid line is a waterline and the fluid comprises water, and wherein the waterline delivers water to the toilet bowl cleaning seat or the bidet seat.

4. The toilet of claim 1, wherein (i) the second fluid line passes through the first seat post or (ii) the seat post is hollow.

5. The toilet of claim 1, wherein the first fluid line comprises a first end configured to be coupled to a water source and a second end configured to be coupled to the junction.

6. The toilet of claim 1, wherein the hole is located in a rear portion of the rim.

7. The toilet of claim 1, wherein the junction is coupled to the toilet tank bottom with tubing or hosing.

8. The toilet of claim 1, wherein the junction is directly fitted to the toilet tank bottom.

9. The toilet of claim 1, wherein the first seat post is a hollow seat post of a toilet seat assembly and wherein the toilet seat assembly further comprises a second seat post.

10. The toilet of claim 1, further comprising an inlet coupled to the first seat post, the inlet configured to couple the second fluid line to the first seat post.

11. The toilet of claim 10, wherein the inlet is integrally formed with the first seat post.

12. The toilet of claim 10, wherein the first seat post is the inlet and is directly coupled to the second fluid line.

13. The toilet of claim 1, wherein (i) the toilet is a flat sided toilet.

14. The toilet of claim 1, wherein the first fluid line and the first seat post are hidden from view when the toilet is installed.

15. The toilet of claim 1, wherein the first fluid line, the second fluid line, the junction, and the first seat post are hidden from view when the toilet is installed.

16. A toilet seat assembly comprising:

a toilet bowel cleaning seat or a bidet seat;

a first seat post configured to allow fluid to flow therethrough;

a second seat post;

a second fluid line configured to couple to the first seat post; and a junction for diverging fluid flow from a first fluid line to a toilet tank bottom and to the second fluid line, wherein the first seat post and the second seat post are configured to couple the toilet seat assembly to a toilet.

17. The toilet seat assembly of claim 16, wherein the first seat post is hollow.

18. The toilet seat assembly of claim 16, wherein the first seat post and the second seat post are hollow.

19. The toilet seat assembly of claim 16, wherein the toilet seat assembly is configured to replace an existing toilet seat assembly on a toilet.

20. The toilet seat assembly of claim 16, further comprising an inlet coupled to the first seat post, wherein the inlet is configured to admit fluid to the first seat post.

21. The toilet seat assembly of claim 20, wherein the inlet is integral with the first seat post.

* * * * *